US007018029B2

(12) United States Patent
Ishizawa et al.

(10) Patent No.: US 7,018,029 B2
(45) Date of Patent: Mar. 28, 2006

(54) LIQUID CONTAINER AND LIQUID EJECTION APPARATUS

(75) Inventors: Taku Ishizawa, Nagano (JP); Hitotoshi Kimura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 123 days.

(21) Appl. No.: 10/691,337

(22) Filed: Oct. 22, 2003

(65) Prior Publication Data

US 2005/0041061 A1 Feb. 24, 2005

(30) Foreign Application Priority Data

Oct. 22, 2002 (JP) ..... P2002-306680

(51) Int. Cl.
*B41J 2/175* (2006.01)
*B41J 2/165* (2006.01)

(52) U.S. Cl. ..... 347/86; 347/36

(58) Field of Classification Search ..... 347/31, 347/36, 85, 86, 87, 90
See application file for complete search history.

(56) References Cited

U.S. PATENT DOCUMENTS 4,695,824 A * 9/1987 Tazaki ..... 347/86
5,157,421 A * 10/1992 Kitahara ..... 347/86
6,135,590 A * 10/2000 Saeki et al. ..... 347/86
6,281,911 B1 8/2001 Nakazawa et al.
6,793,332 B1 * 9/2004 Kaga et al. ..... 347/86
6,908,182 B1 * 6/2005 Nakazawa et al. ..... 347/86

FOREIGN PATENT DOCUMENTS

JP 11-070672 A 3/1999
JP 2001-353882 A 12/2001

* cited by examiner

*Primary Examiner*—Anh T. N. Vo
(74) *Attorney, Agent, or Firm*—Stroock & Stroock & Lavan LLP

(57) ABSTRACT

An ink cartridge comprises an upper cover, and the inside of an inner frame portion of the upper cover is partitioned into a groove and a waste ink storing portion by a wall portion. A waste ink absorber is accommodated in the waste ink storing portion, and the inner frame portion is sealed with a film in this state so that a passage and a waste ink storing chamber are formed. The opening of a lower cover accommodating an ink pack therein is sealed with the upper cover thus constituted so that the ink cartridge is formed. Even if the ink cartridge is turned in various directions such that any surface of the lower cover acts as a lower surface, the position of the ink pack in the ink cartridge is always set to be higher than the liquid level of the ink in an ink bag.

27 Claims, 6 Drawing Sheets

LIQUID CONTAINER AND LIQUID EJECTION APPARATUS

BACKGROUND OF THE INVENTION

1. Field of the Invention

The present invention relates to a liquid container and a liquid ejection apparatus.

2. Related Art

For a liquid ejection apparatus for ejecting a liquid onto a target, an ink jet printer has widely been used. More specifically, the ink jet printer comprises a carriage and a recording head mounted on the carriage. The ink jet printer serves to discharge an ink from a nozzle formed on the recording head while moving the carriage with respect to a recording medium, thereby carrying out printing over the recording medium. In such an ink jet printer, moreover, an ink cartridge is exchangeably provided to be a liquid container storing an ink, and the ink discharged from the recording head is supplied from the ink cartridge.

In recent years, in the ink jet printer, printing has been carried out over a large-sized paper such as an A0 size in some cases. In these cases, an ink cartridge capable of storing an ink having a large capacity has been required because of an increase in the amount of consumption of the ink. If such an ink cartridge having a large capacity is mounted on a carriage, however, the weight of the carriage is increased so that a large load might be applied to a carriage motor. Accordingly, there has generally been employed a structure (a so-called off-carriage type) in which the ink cartridge is not mounted on the carriage.

In some ink cartridges, a space in a case is partitioned into two parts through a plastic film, and an ink bag is accommodated on one side and a waste ink absorber is accommodated on the other side (for example, see JP-A-11-70672) The ink bag includes an ink take-out port. One of the ends of an ink supply tube is connected to the ink take-out port. Moreover, the other end of the ink supply tube is connected to a recording head, and an ink in the ink bag is guided to the recording head through the ink take-out port and the ink supply tube.

Furthermore, the waste ink absorber is connected to one of the ends of a waste liquid tube through a take-in port rubber provided on the case. The other end of the waste liquid tube is connected to a cap provided for cleaning and moisturizing the nozzle of the recording head. Accordingly, a waste ink generated in the cap during the cleaning is guided to the waste ink absorber through the waste liquid tube.

In the case in which the ink cartridge is to be attached to an ink jet printer, the position of the ink bag is provided downward in the gravity direction with respect to the position of the recording head in many cases. The reason is that the ink is to be prevented from being discharged from the ink bag to the recording head, the cap, the pump and the waste ink absorber due to a head difference because the position of the ink bag is set above that of the recording head.

In recent years, however, a small-sized thin ink jet printer has been subjected to off-carriage in addition to the large-sized ink jet printer in some cases. The reason is that the layout of the ink cartridge is to have a degree of freedom. Such an ink jet printer is small-sized and thinned, and at the same time, there is a high possibility that the ink jet printer might be caused to fall down.

In such an ink jet printer, accordingly, there is a possibility that the ink bag might be provided above the recording head in the gravity direction due to the fall-down even if the ink cartridge is provided with the ink bag set below the recording head in the gravity direction. As a result, there is a possibility that the ink might be discharged from the ink bag to the recording head, the cap, the sucking pump and the waste ink absorber, resulting in the wasteful consumption of the ink.

SUMMARY OF THE INVENTION

The invention has been made to solve the problems and has an object to provide a liquid container and a liquid ejection apparatus which can prevent an ink from being discharged from an ink bag to a waste ink absorber even if fall-down is caused.

The invention provides a liquid container comprising: a liquid storing unit storing a liquid to be supplied to a liquid ejection head; and a waste liquid storing unit recovering and storing the liquid passing through the liquid ejection head as a waste liquid, the waste liquid storing unit including: a waste liquid storing chamber holding the waste liquid; and a waste liquid passage guiding the waste liquid to the waste liquid storing chamber, wherein the waste liquid passage is configured such that at least a part thereof is positioned above a liquid level of the liquid stored the liquid storing unit in a gravity direction in each position when the liquid container is positioned so as to direct in a plurality of directions with respect to the gravity direction.

According to the invention, accordingly, at least a part of the waste liquid passage is positioned above the liquid level of the liquid stored the liquid storing unit. Therefore, a predetermined head difference can be maintained. As a result, even if the position of the liquid ejection head is set below the liquid container in the gravity direction due to the fall-down of the liquid ejection apparatus so that the liquid flows as a waste liquid from the liquid storing unit to the waste liquid storing unit through the liquid ejection head, the waste liquid cannot get over the waste liquid passage. Therefore, it is possible to prevent the liquid from being discharged from the liquid storing unit to the waste liquid storing unit.

In the liquid container, the waste liquid passage includes a waste liquid absorber for absorbing and holding a waste liquid therein. Consequently, the liquid is absorbed and held in the waste liquid absorber in the liquid passage. Even if the liquid container is removed from the liquid ejection apparatus, therefore, it is possible to avoid the leakage of the waste liquid from the liquid passage.

In the liquid container, the waste liquid passage is formed by a groove provided on a case of the liquid container and a film covering an opening of the groove. Consequently, the waste liquid passage can easily be formed by the groove and the film. Thus, it is possible to form a waste liquid passage at a low cost.

In the liquid container, the case takes a box shape having one side opened, the groove is formed by partitioning an inner part of the case with a wall face, and the waste liquid storing chamber is formed by covering, with the film, a waste liquid storing portion which is simultaneously partitioned with the wall face.

Consequently, the case is partitioned with the wall so that the groove and the waste liquid storing chamber can be formed at the same time. Thus, it is possible to manufacture the liquid container at a low cost.

In the liquid container, the film forming the waste liquid storing chamber is integrated with the film forming the waste liquid passage. Consequently, the waste liquid passage and the waste liquid storing chamber can be formed by one film at the same time. Therefore, it is possible to manufacture the liquid container at a low cost.

In the liquid container, the waste liquid passage is formed by a flexible tube. Consequently, the waste liquid passage can be turned in various directions in the liquid container. Thus, a design can easily be carried out such that at least a part of the height of the waste liquid passage is increased with respect to the liquid level of the liquid stored the liquid storing unit.

In the liquid container, the waste liquid passage includes a valve device therein. Consequently, the valve device is brought into an opening state when the liquid container is attached to the liquid ejection apparatus, and the valve device is brought into a closing state when the liquid container is removed from the liquid ejection apparatus. Thus, the waste liquid can be prevented from leaking out of the liquid container when the liquid container is removed from the liquid ejection apparatus.

In the liquid container, the waste liquid passage has a volume of 10% or less of a volume of the liquid storable in the liquid storing unit. Consequently, it is possible to lessen the leakage of the liquid when the liquid container is removed from the liquid ejection apparatus. When empty suction for moving the waste liquid in the waste liquid passage to the waste liquid storing chamber is to be carried out immediately before the end of a cleaning operation, moreover, a time required for the empty suction can be shortened because the volume of the waste liquid in the waste liquid passage is small. Moreover, the ink flowing from the recording head to the cap member, the sucking pump and the waste liquid passage due to the fall-down of the liquid ejection apparatus does not get over the waste liquid passage but is stopped in the waste liquid passage. Since the volume of the waste liquid passage is small, however, the amount of the ink to flow into the waste liquid passage can be lessened. As a result, it is possible to reduce the amount of the ink to be wastefully consumed.

The invention provides a liquid ejection apparatus having a liquid container comprising a liquid storing unit storing a liquid to be supplied to a liquid ejection head and a waste liquid storing unit recovering and storing the liquid passing through the liquid ejection head as a waste liquid, the waste liquid storing unit including a waste liquid storing chamber holding the waste liquid, and a waste liquid passage guiding the waste liquid to the waste liquid storing chamber, wherein when the liquid ejection apparatus is positioned in a plurality of directions with respect to a gravity direction, the waste liquid passage is provided such that at least a part of the waste liquid passage is positioned above a liquid level of the liquid stored the liquid storing unit in the gravity direction in each position.

According to the invention, therefore, at least a part of the waste liquid passage is positioned above the liquid level of the liquid stored the liquid storing unit. Therefore, a predetermined head difference can be maintained. As a result, even if the position of the liquid ejection head is set below the liquid container in the gravity direction so that the liquid flows as a waste liquid from the liquid storing unit to the waste liquid storing unit through the liquid ejection head due to the fall-down of the liquid ejection apparatus, the waste liquid cannot get over the waste liquid passage. Accordingly, it is possible to prevent the liquid from being discharged from the liquid storing unit to the waste liquid storing unit.

DETAILED DESCRIPTION OF THE PREFERRED EMBODIMENTS

A specific embodiment of the invention will be described below with reference to FIGS. 1 to 5.

Figure 1:
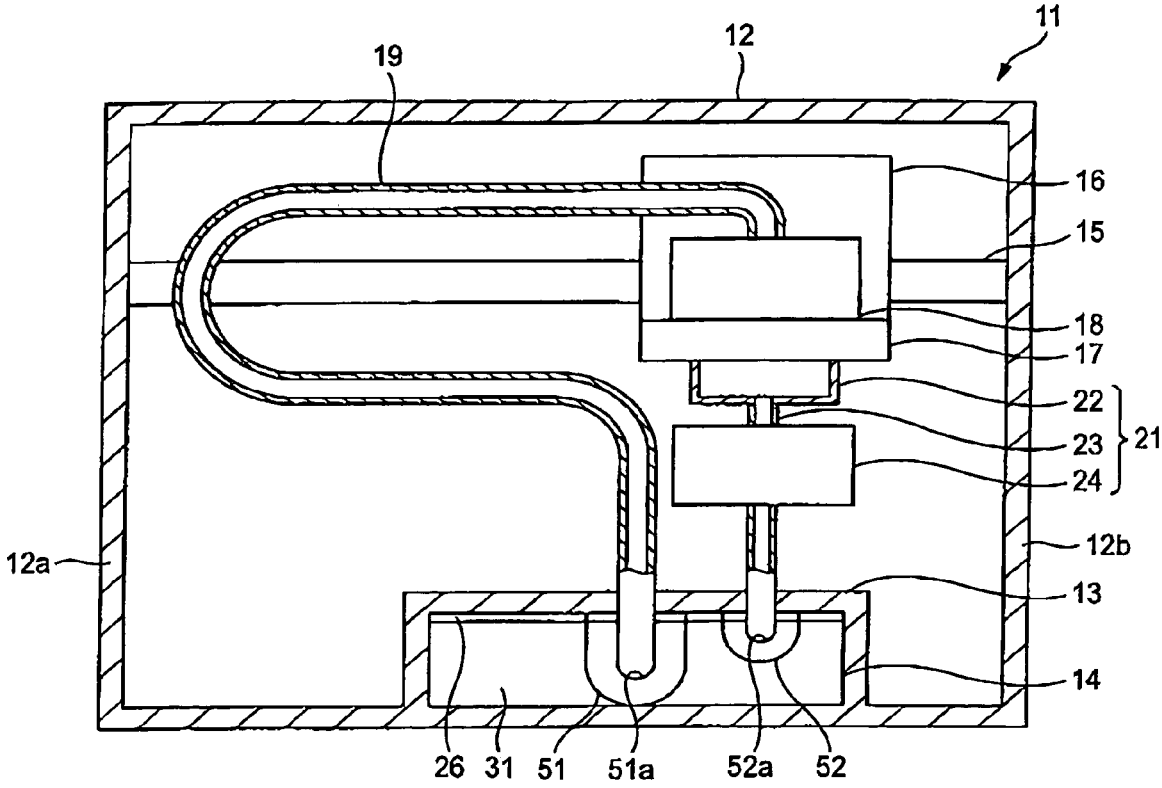
FIG. 1 is a conceptual view showing an inkjet printer according to an embodiment.

FIG. 1 is a conceptual view showing an ink jet printer according to the embodiment. The ink jet printer according to the embodiment is of an off-carriage type in which an ink cartridge is not mounted on a carriage and is a small-sized thin printer in which the layout of the ink cartridge has a degree of freedom.

As shown in FIG. 1, an ink jet printer 11 to be a liquid ejection apparatus comprises a frame 12, and a cartridge holder 13 is formed in the lower part of the frame 12. An ink cartridge 14 to be a liquid container is removably provided in the cartridge holder 13. The ink cartridge 14 can store an ink to be a liquid and can store a waste ink to be a waste liquid, and a detailed description will be given later.

The ink jet printer 11 comprises a guide member 15, and the guide member 15 is provided across the frame 12. A carriage 16 is movably inserted through and supported on the guide member 15 in the axial direction of the guide member 15. The carriage 16 is connected to a carriage motor (not shown) through a timing belt (not shown) and is reciprocated along the guide member 15 by the driving operation of the carriage motor.

A recording head 17 to be a liquid ejection head is provided on the lower surface of the carriage 16, and a damper 18 is mounted on the carriage 16. One of the ends of an ink supply tube 19 formed by a flexible member such as polyethylene is connected to the damper 18, and the other end of the ink supply tube 19 is connected to the ink cartridge 14. Accordingly, the damper 18 receives the supply of the ink from the ink cartridge 14 through the ink supply tube 19. The ink supply tube 19 may have a double structure in which an interior part formed by a flexible member such as a polyethylene type resin having an excellent chemical resistance is covered with an exterior part such as vinyl chloride or a metal film which has an excellent airtight shielding property.

Moreover, the damper 18 is connected to the recording head 17 and supplies the ink from the ink cartridge 14 to the recording head 17. The recording head 17 includes a nozzle discharge port (not shown) on a lower surface thereof, and an ink supplied from the damper 18 is discharged as an ink drop from the nozzle discharge port by the driving operation of a piezoelectric element which is not shown. The ink is discharged from the nozzle discharge port, and at the same time, the carriage 16 is reciprocated with respect to a recording medium (not shown) to be a target. Consequently, the printing can be carried out over the recording medium.

When the carriage 16 is reciprocated along the guide member 15, the ink supply tube 19 is correspondingly flexed so that a fluctuation in a pressure is caused over the ink in the ink supply tube 19. The fluctuation in a pressure is absorbed by the damper 18. In the ink discharged from the recording head 17, accordingly, the fluctuation in a pressure is suppressed.

On the other hand, capping means 21 capable of sealing the nozzle discharge port of the recording head 17 is provided in a non-print region (a home position) on the moving path of the carriage 16. The capping means 21 includes a cap member 22 formed by an elastic material such as a bottomed rubber, and the cap member 22 has an upper opening which can cover and seal the nozzle discharge port of the recording head 17. When the carriage 16 is moved to the home position, the capping means 21 is moved (lifted) toward the recording head 17 side so that the nozzle discharge port of the recording head 17 can be covered by the cap member 22.

The cap member 22 functions as a lid member for covering the nozzle discharge port of the recording head 17 for the pause period of the ink jet printer 11 and for preventing the nozzle discharge port from being dried. Moreover, the capping means 21 includes a waste ink tube 23, and the waste ink tube 23 has one of ends connected to the bottom portion of the cap member 22 and has the other end connected to the ink cartridge 14. Furthermore, the capping means 21 includes a sucking pump 24 in the middle of the waste ink tube 23, and decompresses the inner part of the cap member 22 positioned on the upstream side of the sucking pump 24 by driving the sucking pump 24. By decompressing the inner part of the cap member 22 with the cap member 22 covering the nozzle discharge port of the recording head 17, it is possible to execute a cleaning operation for sucking the ink from the nozzle discharge port of the recording head 17.

The ink sucked from the nozzle discharge port of the recording head 17 is discharged to the ink cartridge 14 through the waste ink tube 23. In the embodiment, the home position is set on the right side of the cartridge holder 13 as shown in FIG. 1.

Next, the ink cartridge 14 will be described.

Figure 2:
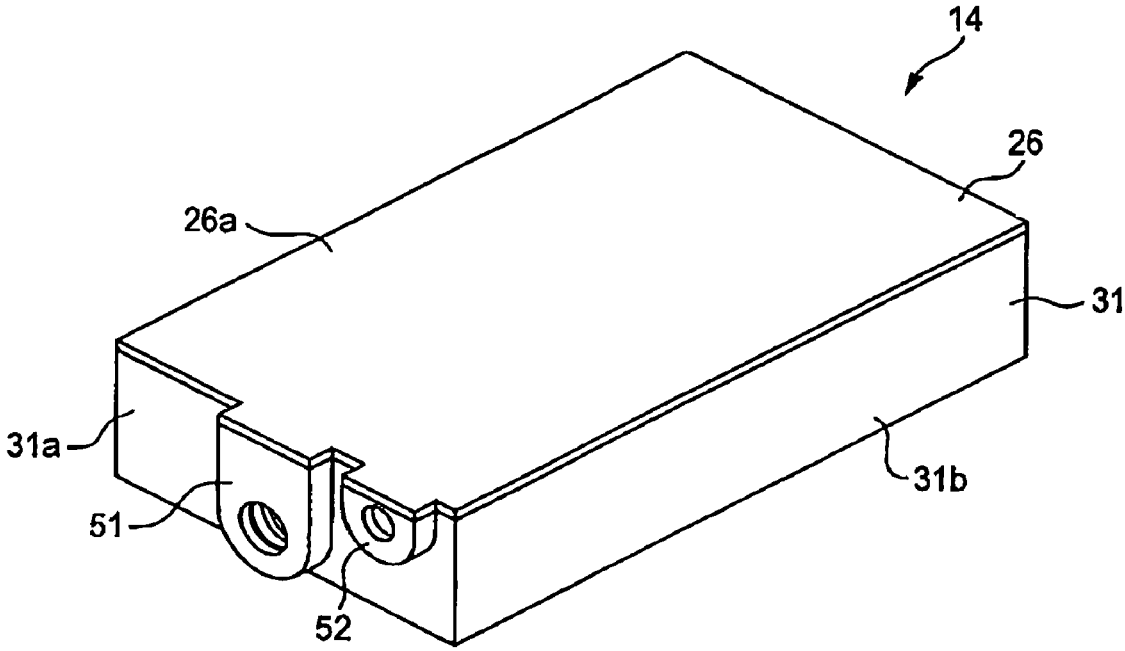
FIG. 2 is a perspective view showing an ink cartridge.
Figure 3:
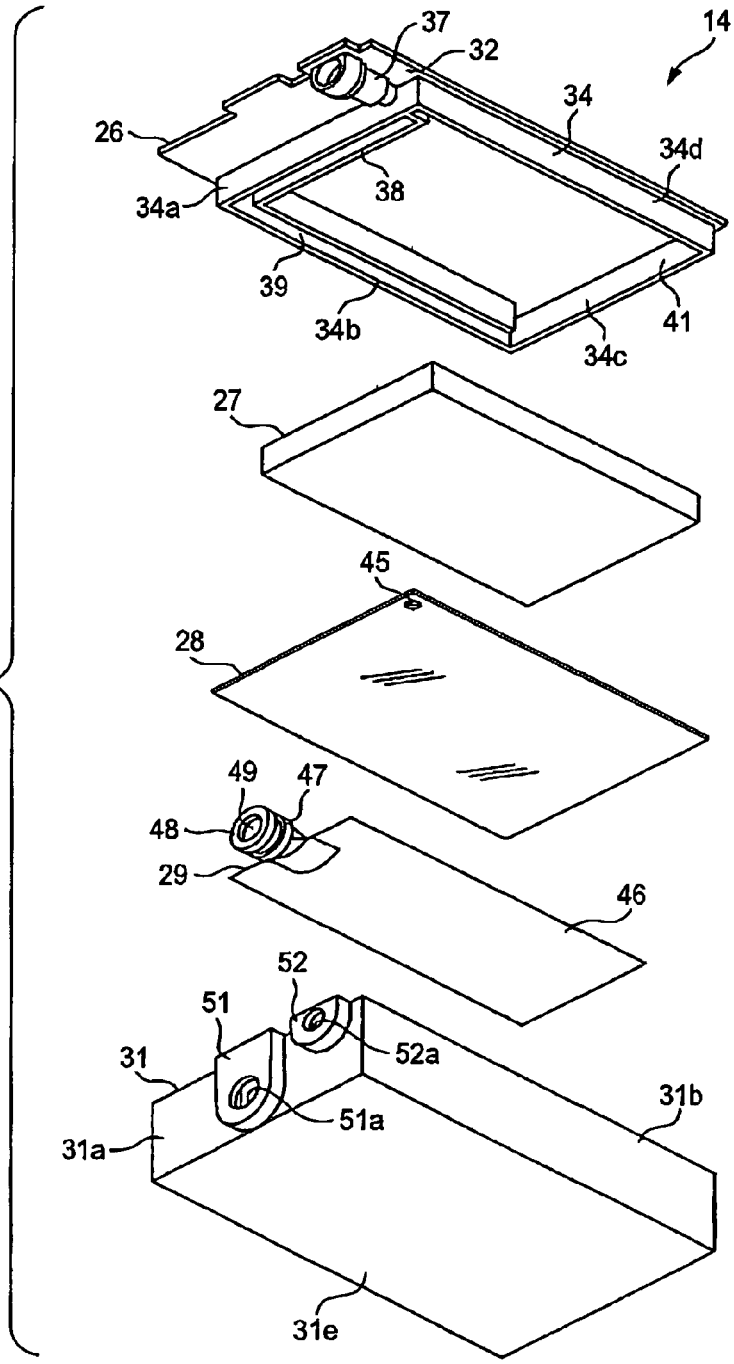
FIG. 3 is an exploded perspective view showing the ink cartridge.
Figure 4:
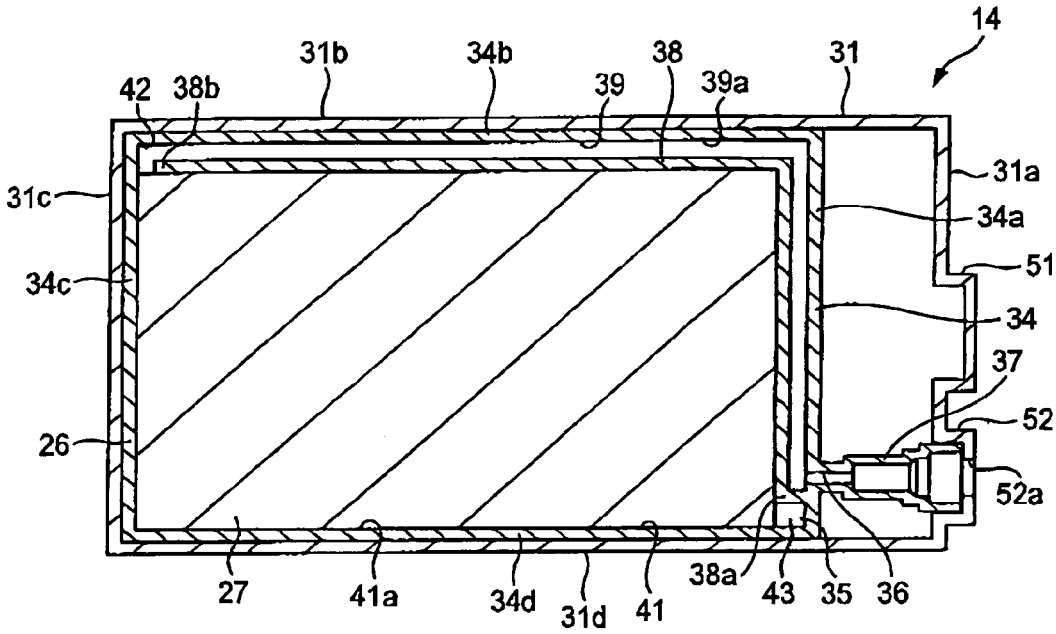
FIG. 4 is a sectional view showing the ink cartridge.

As shown in FIG. 2, the ink cartridge 14 has the shape of an almost rectangular parallelepiped. As shown in FIG. 3, the ink cartridge 14 includes an upper cover 26 to be a case, a waste ink absorber 27 to be a waste liquid absorber, a film 28, an ink pack 29 to be liquid storing unit, and a lower cover 31. The upper cover 26 includes a rectangular plate-shaped portion 32 and an inner frame portion 34 erected rectangularly like a frame from the plate-shaped portion 32 in an inner position from the peripheral edge of the plate-shaped portion 32. As shown in FIG. 4, the inner frame portion 34 has four side surfaces, that is, a first side surface 34*a*, a second side surface 34*b*, a third side surface 34*c* and a fourth side surface 34*d*.

A through hole 36 for causing the inside and outside of the first side surface 34*a* to communicate with each other is provided in the vicinity of a first corner portion 35 formed by the first side surface 34*a* and the fourth side surface 34*d*. Moreover, a cylindrical waste liquid introducing portion 37 is protruded from the outer side surface of the first side surface 34*a* to surround the through hole 36.

Furthermore, the upper cover 26 has a wall portion 38 to be an L-shaped wall face in parallel with the first side surface 34*a* and the second side surface 34*b* on the inside of the inner frame portion 34. The height of the wall portion 38 is equal to that of the inner frame portion 34. Accordingly, a groove 39 is formed by a partition between the wall portion 38 and the first side surface 34*a* and second side surface 34*b*. Moreover, a waste ink storing portion 41 to be a waste liquid storing portion having the shape of an almost rectangular parallelepiped is formed by a partition between the wall portion 38 and the third side surface 34*c* and fourth side surface 34*d*.

The wall portion 38 has one end 38*a* bonded in a close position to the first corner portion 35 from the position of the through hole 36 with respect to the first side surface 34*a*. Moreover, the other end 38*b* of the wall portion 38 is positioned so as not to come in contact with the inner frame portion 34 in a second corner portion 42 formed by the second side surface 34*b* and the third side surface 34*c*. Accordingly, the groove 39 communicates with the through hole 36 in the vicinity of the first corner portion 35, and furthermore, communicates with the waste ink storing portion 41 in the vicinity of the second corner portion 42 opposed to the first corner portion 35. As a result, in the case in which a waste ink flows via the through hole 36, for example, the waste ink moves in the groove 39 along the first side surface 34*a* and the second side surface 34*b* and flows into the waste ink storing portion 41 in the second corner portion 42.

The waste ink absorber 27 is formed by a porous material, and takes the shape of a rectangular parallelepiped and has such a size and thickness as to be exactly fitted in the waste ink storing portion 41 of the upper cover 26 as shown in FIG. 3. As shown in FIG. 4, the waste ink absorber 27 is accommodated in the waste ink storing portion 41. A rectangular void 43 formed by the wall portion 38 is provided in the vicinity of the first corner portion 35 in the waste ink storing portion 41. The waste ink absorber 27 is not present in the void 43.

Figure 5:
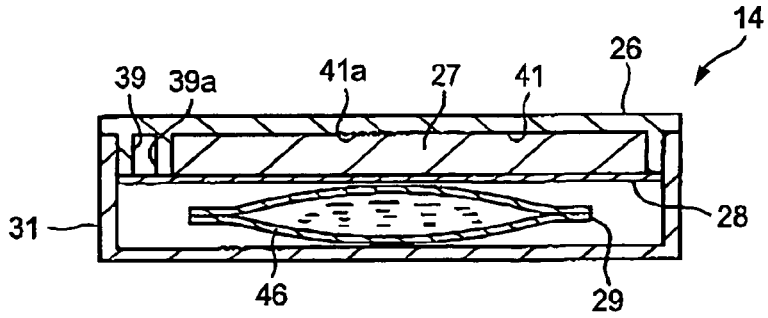
FIG. 5 is a sectional view showing the ink cartridge.

As shown in FIG. 3, the film 28 has a rectangular shape and is formed of polystyrene, a rubber type material or PET, for example. The peripheral edge portion of the film 28 is thermally welded to the inner frame portion 34, thereby sealing the inside of the inner frame portion 34. As shown in FIG. 5, accordingly, the opening of the groove 39 is sealed with the film 28 so that a passage 39*a* to be a waste liquid passage is formed. Moreover, the opening of the waste ink storing portion 41 is sealed with the film 28 in a state in which the waste ink absorber 27 is accommodated. Consequently, a waste ink storing chamber 41*a* to be a waste liquid storing chamber is formed. In the embodiment, a waste liquid storing unit is constituted by the passage 39*a*, the waste ink storing chamber 41*a* and the waste ink absorber 27.

The volume of the passage 39*a* is 10% or less of that of the ink storable in the ink pack 29. The reason is that the amount of leakage of the ink remaining in the passage 39*a* is to be reduced when the ink cartridge 14 is removed from the cartridge holder 13. In the cleaning operation, moreover, empty suction for discharging the whole ink in the cap member 22, the waste ink tube 23 and the passage 39*a* to the waste ink absorber 27 is carried out immediately before the end of the cleaning operation. By decreasing the volume of the passage 39*a*, it is possible to shorten a time required for the empty suction. Moreover, the ink flowing from the recording head 17 to the cap member 22, the sucking pump 24 and the passage 39*a* due to the fall-down of the ink jet printer 11 does not get over the passage 39*a* but is stopped in the passage 39*a*. Since the volume of the passage 39*a* is small, the amount of the ink flowing to the passage 39*a* can be decreased. As a result, it is possible to decrease the amount of the ink to be consumed wastefully.

As shown in FIG. 3, furthermore, the film 28 has a vent 45 in a position opposed to the void 43 of the waste ink storing portion 41. Consequently, excess air in the waste ink storing chamber 41*a* formed by the waste ink storing portion 41 and the film 28, can be discharged to the outside.

The, ink pack 29 has an ink bag 46 and an ink take-out port 47. The ink bag 46 is formed by a flexible material, and is formed by an aluminum laminate film having such a structure that an outside is held by a nylon film and an inside is held by a polyethylene film in order to enhance a gas barrier property, for example. The ink bag 46 is formed by superposing two aluminum laminate films having almost rectangular shapes and bonding their peripheries through thermal welding, and stores an ink therein.

The ink take-out port 47 has a cylindrical portion 48 formed of plastics, for example. The cylindrical portion 48 is attached to a part of the bonding portion of the two aluminum laminate films of the ink bag 46 through the thermal welding, and can be fixed such that the ink in the ink bag 46 can be led to the outside.

Moreover, the ink take-out port 47 has a take-out port rubber 49, and the take-out port rubber 49 is fitted in the cylindrical portion 48. The ink in the ink bag 46 is sealed by the take-out port rubber 49.

The lower cover 31 is a box member in which an upper side having the shape of an almost rectangular parallelepiped is opened, and has such a size that the inner frame portion 34 of the upper cover 26 can be inserted. A side surface 31*a* is provided with a first projection 51 and a second projection 52 to be protruded outward. The first projection 51 and the second projection 52 have arcuate shapes at their lower parts, respectively.

The ink take-out port 47 of the ink pack 29 can be fitted in the first projection 51, and the ink take-out port 47 is fitted in the first projection 51 so that the ink pack 29 is accommodated in the lower cover 31. Moreover, an ink supply hole 51*a* is formed to penetrate through the first projection 51 in a position opposed to the ink take-out port 47 of the ink pack 29.

Furthermore, the waste liquid introducing portion 37 of the upper cover 26 can be fitted in the second projection 52, and the waste liquid introducing portion 37 is fitted in the second projection 52 so that the upper cover 26 seals the opening of the lower cover 31. Moreover, an ink discharge port 52*a* is formed to penetrate through the second projection 52 in a position opposed to the waste liquid introducing portion 37 of the upper cover 26. The position of the ink discharge port 52*a* is set close to the opening of the lower cover 31 from the ink supply hole 51*a*.

As shown in FIG. 5, accordingly, the ink cartridge 14 is formed by accommodating the ink pack 29 in the lower cover 31 and then inserting, into the lower cover 31, the upper cover 26 accommodating the waste ink absorber 27 therein and sealing the same with the film 28, and sealing the opening of the lower cover 31. At this time, the ink bag 46 of the ink pack 29 is accommodated in the ink cartridge 14 such that a position in a vertical direction thereof is set onto the inside of the passage 39*a* in the ink cartridge 14.

More specifically, even if the direction of the ink cartridge 14 is changed such that any of side surfaces 31*a*, 31*b*, 31*c* and 31*d* (see FIG. 4) and a bottom face 31*e* (see FIG. 3) of the lower cover 31 acts as a lower surface, any portion of the passage 39*a* is always positioned to be higher than the liquid level of the ink in the ink bag 46.

As shown in FIG. 1, the ink cartridge 14 is accommodated in the cartridge holder 13 such that the lower cover 31 is positioned on the lower side and the upper cover 26 is positioned on the upper side in a state in which the ink jet printer 11 is normally provided. Moreover, the ink supply hole 51*a* is positioned on the left side of the ink discharge port 52*a*.

The ink supply tube 19 is connected to the ink pack 29 of the ink cartridge 14 through the ink supply hole 51*a* More specifically, the ink supply tube 19 has a hollow ink supply needle (not shown) at an end thereof, and the ink supply needle penetrates through the take-out port rubber 49 provided on the ink take-out port 47 of the ink pack 29 and reaches the ink so that the ink pack 29 and the ink supply tube 19 are connected to each other.

Moreover, the waste ink absorber 27 of the ink cartridge 14 is connected to the waste ink tube 23 through the passage 39*a*, the waste liquid introducing portion 37 and the ink discharge port 52*a*. More specifically, the waste ink tube 23 has a hollow waste liquid needle (not shown) at an end thereof, and the waste liquid needle reaches the passage 39*a* through the waste liquid introducing portion 37 so that the waste ink absorber 27 and the waste ink tube 23 are connected to each other.

Next, description will be given to the action of the ink jet printer 11 having the structure described above.

First of all, description will be given to the case in which the ink jet printer 11 is set in a normal installation state, that is, the ink cartridge 14 is positioned in the lower part of the ink jet printer 11 as shown in FIG. 1. When the ink jet printer 11 is set in a rest state, the carriage 16 is moved to the home position so that the nozzle discharge port of the recording head 17 is, covered with the capping means 21. At this time, the ink is present in the ink supply tube 19, the damper 18 and the recording head 17, and is not present in the capping means 21 and the passage 39*a* (see FIG. 5).

In this state, the ink cartridge 14 is positioned below the recording head 17 in the gravity direction. More specifically, in this state, a negative pressure is applied to the recording head 17. Accordingly, the ink stored in the ink pack 29 of the ink cartridge 14 cannot move to the damper 18 through the ink supply tube 19 due to a head difference between the ink cartridge 14 and the recording head 17. At this time, the ink in the recording head 17 can be prevented from reversely flowing to the ink cartridge 14 through the damper 18 and the ink supply tube 19 by the action of a meniscus formed in the nozzle discharge port of the recording head 17.

As a result, the ink in the ink pack 29 of the ink cartridge 14 can be prevented from being discharged to the waste ink absorber 27 through the recording head 17. In other words, if the position of the recording head 17 is set above that of the ink cartridge 14 in the gravity direction, the ink in the ink pack 29 can be prevented from being discharged.

Next, description will be given to the case in which the ink jet printer 11 is provided in a different direction from usual due to a transfer between users and the position of the ink cartridge 14 is set above that of the recording head 17 in the gravity direction.

In some cases in which the position of the ink cartridge 14 is set above that of the recording head 17 in the gravity direction, the ink jet printer 11 is caused to fall down so that a left side wall 12*a* of the frame 12 shown in FIG. 1 is positioned above a right side wall 12*b* in the gravity direction. In these cases, the position of the ink cartridge 14 is set above the home position, that is, the position of the recording head 17 in the gravity direction.

In these cases, referring to the direction of the ink cartridge 14, the ink supply hole 51*a* is positioned above the ink discharge port 52*a* in the gravity direction. Referring to the passage 39*a* formed in the ink cartridge 14 (see FIG. 5), however, any portion is positioned above the liquid level of the ink in the ink pack 29 in the gravity direction. Even if the ink in the ink cartridge 14 can reach the passage 39*a*, accordingly, it cannot resist a head difference made by a difference between the liquid level of the ink in the ink pack 29 and the height of the passage 39*a* and cannot pass through the passage 39*a*. As a result, the ink cannot reach the waste ink absorber 27 so that the ink can be prevented from being discharged from the ink pack 29 to the waste ink absorber 27.

According to the embodiment, the following advantages can be obtained.

(1) In the embodiment, even if the ink cartridge 14 is changed in various directions such that each surface of the lower cover 31 acts as the lower surface, at least a part of the passage 39*a* is always positioned above the liquid level of the ink in the ink pack 29. Accordingly, it is possible to maintain the head difference between the passage 39*a* and the liquid level of the ink in the ink pack 29. As a result, even if the position of the recording head 17 is set below that of the ink cartridge 14 in the gravity direction due to the fall-down of the ink jet printer 11 so that the ink flows as a waste ink from the ink pack 29 to the passage 39*a* through the recording head 17, the ink cannot get over the passage 39*a*. Accordingly, it is possible to prevent the ink from being discharged from the ink pack 29 to the waste ink absorber 27 of the waste liquid storing chamber.

(2) In the embodiment, the passage 39*a* is formed by covering the groove 39 with the film 28. Accordingly, the passage 39*a* can be formed at a low cost.

(3) In the embodiment, the inner part of the inner frame portion 34 of the upper cover 26 is partitioned by the wall portion 38 to form the groove 39 and the waste ink storing portion 41. By partitioning the inner frame portion 34 with the wall portion 38, accordingly, it is possible to form the groove 39 and the waste ink storing portion 41 at the same time. Consequently, the ink cartridge 14 can be manufactured at a low cost.

(4) In the embodiment, the groove 39 and the waste ink storing portion 41 are simultaneously covered with one film 28 so that the passage 39*a* and the waste ink storing chamber 41*a* are formed at the same time. Accordingly, a process for manufacturing the ink cartridge 14 can be simplified so that the ink cartridge 14 can be manufactured at a low cost.

(5) In the embodiment, the volume of the passage 39*a* is set to be 10% or less of that of the ink storable in the ink pack 29. In the case in which the ink cartridge 14 is removed from the cartridge holder 13, accordingly, it is possible to reduce the amount of leakage of the ink remaining in the passage 39*a*. In the cleaning operation, moreover, the empty suction for discharging the whole ink in the cap member 22, the waste ink tube 23 and the passage 39*a* to the waste ink absorber 27 is carried out immediately before the end of the cleaning operation. By decreasing the volume of the passage 39*a*, it is possible to shorten a time required for the empty suction. Moreover, the ink flowing from the recording head 17 to the cap member 22, the sucking pump 24 and the passage 39*a* due to the fall-down of the ink jet printer 11 does not get over the passage 39*a* but is stopped in the passage 39*a*. Since the volume of the passage 39*a* is small, the amount of the ink flowing into the passage 39*a* can be decreased. As a result, it is possible to lessen the amount of the ink to be consumed wastefully.

The embodiment may be changed as follows.

Figure 6:
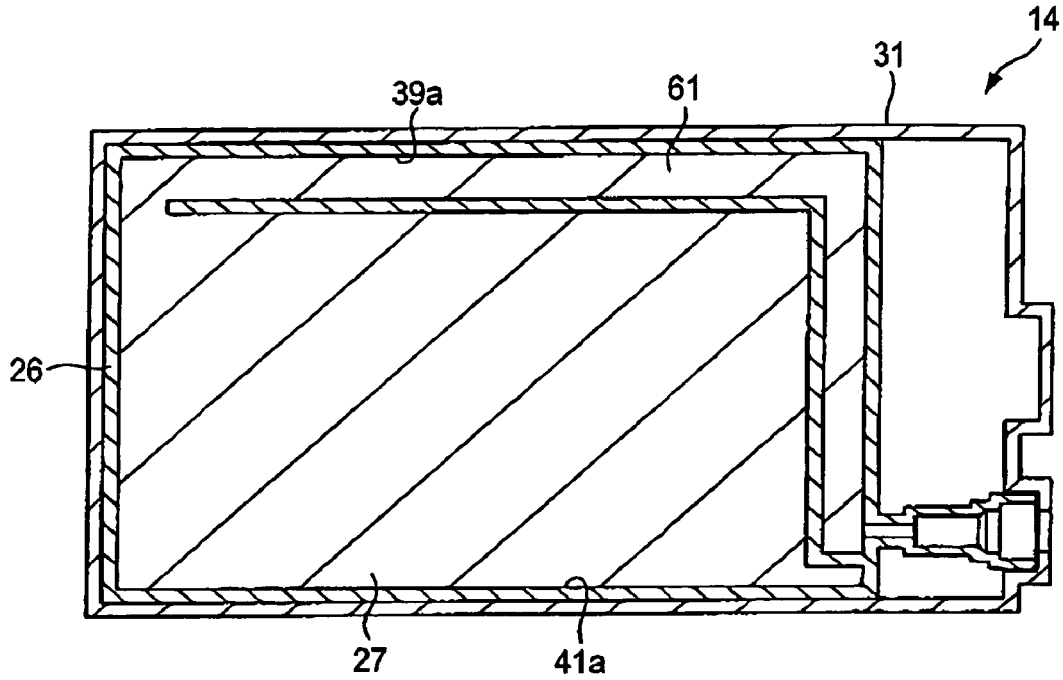
FIG. 6 is a sectional view showing an ink cartridge according to another embodiment.

In the embodiment, the waste ink absorber 27 is not provided in the passage 39*a*. As shown in FIG. 6, a waste ink absorber 61 integrated with the waste ink absorber 27 in the waste ink storing chamber 41*a* may be provided in the passage 39*a*. Moreover, the ink absorber 61 may be provided separately from the waste ink absorber 27.

Even if the ink cartridge 14 is removed from the ink jet printer 11, consequently, the waste ink remaining in the passage 39*a* is absorbed and held in the waste ink absorber 61. Thus, it is possible to avoid the leakage of the waste ink from the passage 39*a*.

While the passage 39*a* and the waste ink storing chamber 41*a* are formed by using the same film 28 in the embodiment, the passage 39*a* and the waste ink storing chamber 41*a* may be formed by using separate films, respectively.

Figure 7:
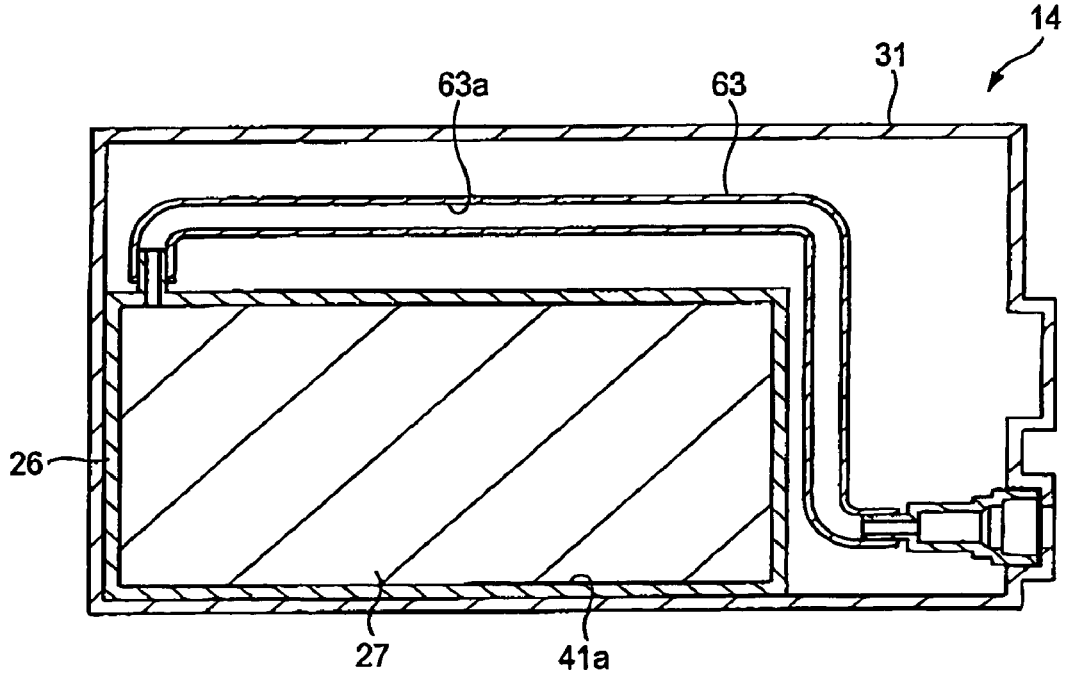
FIG. 7 is a sectional view showing an ink cartridge according to yet another embodiment.

In the embodiment, the passage 39*a* to be a waste liquid passage is formed by covering the groove 39 with the film 28. As shown in FIG. 7, a passage 63*a* to be a waste liquid passage may be formed by a flexible tube 63. Consequently, the passage 63*a* can be turned in various directions in the ink cartridge 14 so that a degree of freedom of a design can be increased.

Figure 8:
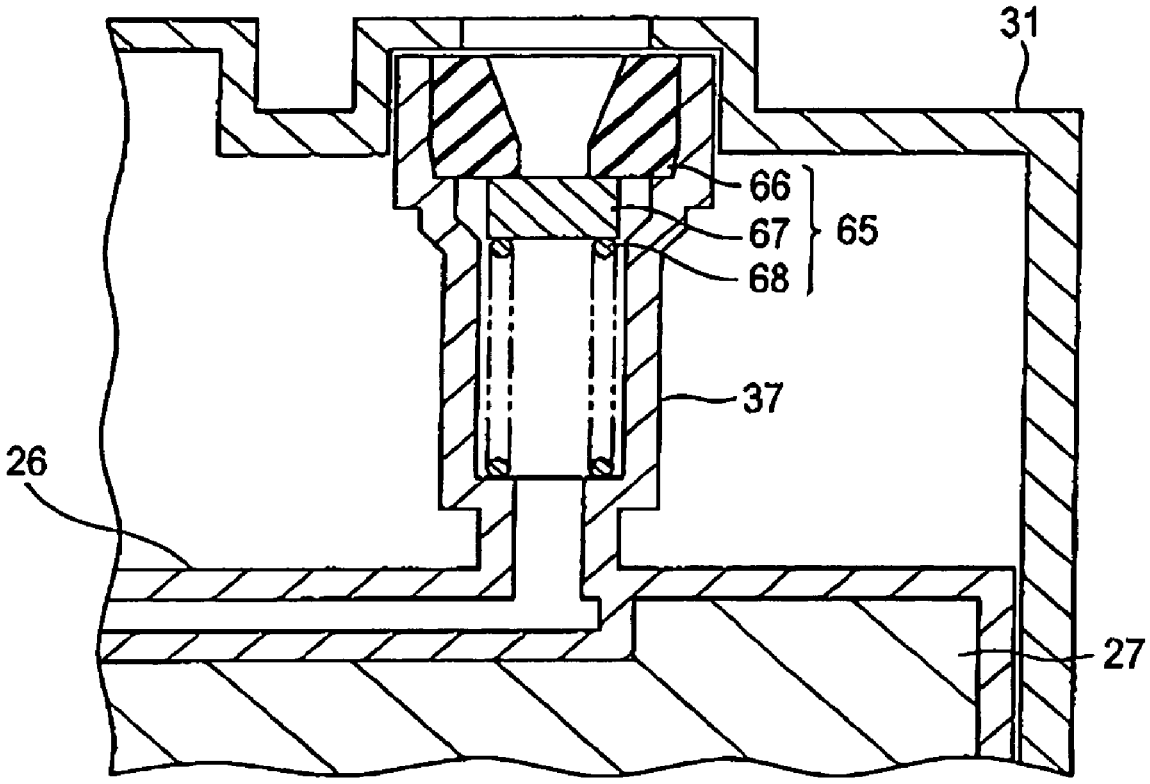
FIG. 8 is a partial sectional view showing an ink cartridge according to a further embodiment.

In the embodiment, the cylindrical waste liquid introducing portion 37 is simply provided on the entry of the passage 39*a*. As shown in FIG. 8, a valve device 65 may be provided on the inside of the waste liquid introducing portion 37. The valve device 65 includes a valve seat 66 formed by an elastic member such as a circular rubber, an almost cylindrical valve member 67, and a spring 68. The valve seat 66, the valve member 67 and the spring 68 are arranged in this order from an upstream toward a downstream in the waste liquid introducing portion 37. In a state in which external force is not applied, the valve member 67 is energized by the spring 68 to abut on the valve seat 66 so that the valve device 65 is brought into a closing state.

Moreover, a hollow waste liquid needle is inserted through the valve seat 66 to abut on the valve member 67, thereby pressing the valve member 67 toward the downstream side. Consequently, the valve member 67 is separated from the valve seat 66 so that the valve device 65 is brought into an opening state.

By providing such a valve device 65, it is possible to prevent the waste ink remaining in the passage 39*a* from leaking to the outside when the ink cartridge 14 is removed from the ink jet printer 11. For the valve device 65, it is also possible to use any valve device of another type which is brought into the opening state when the ink cartridge 14 is attached to the ink jet printer 11, and is brought into the closing state when the ink cartridge 14 is removed from the ink jet printer 11.

In the embodiment, the volume of the passage 39*a* is set to be 10% or less of that of the ink storable in the ink pack 29. The volume of the passage 39*a* may be more than 10%.

While the passage 39*a* is turned in the two-dimensional direction along the direction of the plane of the upper cover 26 in the embodiment, it may be turned in a three-dimensional direction. In the case in which an upper surface 26*a* of the upper cover 26 (see FIG. 2) acts as the lower surface in addition to the case in which any of the side surfaces 31*a*, 31*b*, 31*c*, 31*d* and the bottom face 31*e* of the lower cover 31 acts as the lower surface, consequently, a part of the passage 39*a* can be set to be higher than the liquid level of the ink of the ink pack 29. Accordingly, it is possible to more reliably prevent the ink from being discharged from the ink pack 29 to the waste ink absorber 27.

While the ink jet printer is small-sized and thinned in the embodiment, a large-sized printer may be specifically used.

While the structure of the ink jet printer 11 using an ink having one color has been described in the embodiment, the ink jet printer 11 may have such a structure as to correspond to a plurality of inks of cyan, magenta, yellow and black, for example. In such a case, the ink supply tube 19 and the damper 18 are provided corresponding to the number of the inks. The ink cartridge 14 may be provided corresponding to the number of the inks or a plurality of ink packs 29 may be accommodated in the single ink cartridge 14.

While the printer for discharging an ink (a printer including a fax and a copier) has been described as a liquid ejection apparatus in the embodiment, a liquid ejection apparatus for ejecting another liquid may be used. For example, it is also possible to use a liquid ejection apparatus for ejecting a liquid such as an electrode material or a coloring material to be used for manufacturing a liquid crystal display, an EL display or an FED (a surface emitting display), a liquid ejection apparatus for ejecting an organism to be used for manufacturing a biochip and a sample ejection apparatus to be a precision pipette.

What is claimed is:

1. A liquid container comprising:

a liquid storing unit storing a liquid to be supplied to a liquid ejection head;

a waste liquid storing unit recovering and storing the liquid passing through the liquid ejection head that is a waste liquid; and a case in which the waste liquid storing unit is provided, the waste liquid storing unit including:

a waste liquid storing chamber holding the waste liquid; and a waste liquid passage guiding the waste liquid to the waste liquid storing chamber, wherein the waste liquid passage is arranged between opposite ends of the case in at least two directions such that at least a part thereof is positioned above a liquid level of the liquid stored in the liquid storing unit with respect to a direction of gravity in each position when the liquid container is positioned so as to direct in a plurality of directions with respect to the direction of gravity.

2. A liquid container comprising:

a liquid storing unit storing a liquid to be supplied to a liquid ejection head; and a waste liquid storing unit recovering and storing the liquid passing through the liquid ejection head that is waste liquid, the waste liquid storing unit including:

a waste liquid storing chamber holding the waste liquid; and a waste liquid passage guiding the waste liquid to the waste liquid storing chamber, wherein the waste liquid passage is arranged such that at least a part thereof is positioned above a liquid level of the liquid stored in the liquid storing unit with respect to a direction of gravity in each position when the liquid container is positioned so as to direct in a plurality of directions with respect to the direction of gravity, wherein the waste liquid passage includes a valve device therein.

3. A liquid container comprising:

a liquid storing unit storing a liquid to be supplied to a liquid ejection head; and a waste liquid storing unit recovering and storing the liquid passing through the liquid ejection head that is a waste liquid, the waste liquid storing unit including:

a waste liquid storing chamber holding the waste liquid; and a waste liquid passage guiding the waste liquid to the waste liquid storing chamber, wherein the waste liquid passage is arranged such that at least a part thereof is positioned above a liquid level of the liquid stored in the liquid storing unit with respect to a direction of gravity in each position when the liquid container is positioned so as to direct in a plurality of directions with respect to the direction of gravity, wherein the waste liquid passage has a volume of not more than 10% of a volume of the liquid storable in the liquid storing unit.

4. The liquid container according to claim 1, wherein the waste liquid passage is formed by a flexible tube.

5. The liquid container according to claim 4, wherein the waste liquid passage includes a valve device therein.

6. The liquid container according to claim 4, wherein the waste liquid passage has a volume of not more than 10% of a volume of the liquid storable in the liquid storing unit.

7. A liquid container comprising:

a liquid storing unit storing a liquid to be supplied to a liquid ejection head; and a waste liquid storing unit recovering and storing the liquid passing through the liquid ejection head that is a waste liquid, the waste liquid storing unit including:

a waste liquid storing chamber holding the waste liquid; and a waste liquid passage guiding the waste liquid to the waste liquid storing chamber, wherein the waste liquid passage is arranged such that at least a part thereof is positioned above a liquid level of the liquid stored in the liquid storing unit with respect to a direction of gravity in each position when the liquid container is positioned so as to direct in a plurality of directions with respect to the direction of gravity, wherein the waste liquid passage includes a waste liquid absorber which absorbs and holds at least some of the waste liquid therein.

8. The liquid container according to claim 7, wherein the waste liquid passage is defined by a groove provided on a case of the liquid container and a film covering an opening of the groove.

9. The liquid container according to claim 8, wherein the case has the shape of a box with one side open, the groove is formed by partitioning an inner part of the case with a wall face, and the waste liquid storing chamber is formed by covering with the film a waste liquid storing portion which is simultaneously partitioned with the wall face.

10. The liquid container according to claim 9, wherein the film forming the waste liquid storing chamber is integrated with the film forming the waste liquid passage.

11. The liquid container according to claim 7, wherein the waste liquid passage is formed by a flexible tube.

12. The liquid container according to claim 7, wherein the waste liquid passage includes a valve device therein.

13. The liquid container according to claim 7, wherein the waste liquid passage has a volume of not more than 10% of a volume of the liquid storable in the liquid storing unit.

14. A liquid container comprising:

a liquid storing unit storing a liquid to be supplied to a liquid ejection head; and a waste liquid storing unit recovering and storing the liquid passing through the liquid ejection head that is a waste liquid, the waste liquid storing unit including:

a waste liquid storing chamber holding the waste liquid; and a waste liquid passage guiding the waste liquid to the waste liquid storing chamber, wherein the waste liquid passage is arranged such that at least a part thereof is positioned above a liquid level of the liquid stored in the liquid storing unit with respect to a direction of gravity direction in each position when the liquid container is positioned so as to direct in a plurality of directions with respect to the direction of gravity, wherein the waste liquid passage is defined by a groove provided on a case of the liquid container and a film covering an opening of the groove.

15. The liquid container according to claim 14, wherein the case has the shape of a box with one side open, the groove is formed by partitioning an inner part of the case with a wall face, and the waste liquid storing chamber is formed by covering with the film a waste liquid storing portion which is simultaneously partitioned with the wall face.

16. The liquid container according to claim 15, wherein the film forming the waste liquid storing chamber is integrated with the film forming the waste liquid passage.

17. The liquid container according to claim 14, wherein the waste liquid passage includes a valve device therein.

18. The liquid container according to claim 14, wherein the waste liquid passage has a volume of not more than 10% of a volume of the liquid storable in the liquid storing unit.

19. A liquid ejection apparatus having a liquid container comprising a liquid storing unit storing a liquid to be supplied to a liquid ejection head and a waste liquid storing unit recovering and storing the liquid passing through the liquid ejection head that is a waste liquid, the waste liquid storing unit including:

a waste liquid storing chamber holding the waste liquid; and a waste liquid passage guiding the waste liquid to the waste liquid storing chamber, wherein the waste liquid passage is arranged between opposite ends of the case in at least two directions such that at least a part thereof is positioned above a liquid level of the liquid stored in the liquid storing unit with respect to a direction of gravity in each position when the liquid container is positioned so as to direct in a plurality of directions with respect to the direction of gravity.

20. A liquid container comprising:

a liquid storing unit storing a liquid to be supplied to a liquid ejection head;

a waste liquid storing unit recovering and storing the liquid passing through the liquid ejection head that is a waste liquid, the waste liquid storing unit having a waste liquid storing chamber; and a cover, in which the waste liquid storing chamber is provided, including a plate-shaped portion and an inner frame portion projected from the plate-shaped portion, the inner frame portion having a first side surface and a second side surface adjacent to the first side surface on an inside thereof, and a wall portion projected from the plate-shaped portion having a first part substantially in parallel with the first side surface and a second part substantially in parallel with the second side surface, wherein a groove is defined between the wall portion and the first and second side surfaces of the inner frame portion so as to extend along the first and second side surfaces and so as to communicate with the waste liquid storing chamber.

21. A liquid container according to claim 20, wherein a through hole is formed in the first side surface of the inner frame portion.

22. A liquid container according to claim 20, wherein the wall portion has an L-shaped wall face.

23. A liquid container according to claim 20, wherein the inner frame portion includes third and fourth inner side surfaces, and one end of the wall portion is connected to the inner frame portion near a first corner portion that is formed between the first side surface and the fourth side surface, and another end of the wall portion is located near a second corner portion that is formed between the second side surface and the third side surface so as to oppose the first corner portion where the groove communicates with the waste liquid storing chamber.

24. A liquid container according to claim 20, wherein the waste liquid storing chamber has a substantially rectangular parallelepipedal shape, the waste liquid storing chamber being surrounded by the wall portion, the third side surface and the fourth side surface.

25. A liquid container according to claim 20, wherein an opening of the groove and an opening of the waste liquid storing chamber are covered with a film.

26. A liquid container according to claim 20, wherein a waste liquid absorber is provided in the groove.

27. A liquid container according to claim 20, wherein the groove has a volume of not more than 10% of a volume of the liquid storable in the liquid storing unit.

* * * * *